US007204714B2

(12) United States Patent
Walker et al.

(10) Patent No.: US 7,204,714 B2
(45) Date of Patent: Apr. 17, 2007

(54) MODULAR IN-WALL MEDICAL SERVICES OUTLET SYSTEM

(75) Inventors: James A. Walker, Oklahoma City, OK (US); Taylor C. Culpepper, Oklahoma City, OK (US); John R. Pierson, Guthrie, OK (US)

(73) Assignee: Modular Services Company, Oklahoma City, OK (US)

( * ) Notice: Subject to any disclaimer, the term of this patent is extended or adjusted under 35 U.S.C. 154(b) by 128 days.

(21) Appl. No.: 10/846,007

(22) Filed: May 14, 2004

(65) Prior Publication Data

US 2004/0231248 A1 Nov. 25, 2004

Related U.S. Application Data

(60) Provisional application No. 60/471,224, filed on May 16, 2003.

(51) Int. Cl.
*H01R 13/60* (2006.01)

(52) U.S. Cl. ..... 439/532; 439/536

(58) Field of Classification Search ..... 439/716, 439/532, 536, 107; 174/53; 200/43.8
See application file for complete search history.

(56) References Cited

U.S. PATENT DOCUMENTS

| | | | |
|---|---|---|---|
| 1,287,699 | A | 12/1918 | Kinsman |
| 1,606,870 | A | 11/1926 | Corwin |
| 2,762,387 | A | 9/1956 | Orwin |
| 2,773,728 | A | 12/1956 | La Barre |
| 3,131,512 | A | 5/1964 | MacLeod, Jr. |
| 3,199,063 | A | 8/1965 | Stuart |
| 3,200,244 | A | 8/1965 | Meyer |

(Continued)

FOREIGN PATENT DOCUMENTS

| | | |
|---|---|---|
| CA | 510857 | 3/1955 |

(Continued)

OTHER PUBLICATIONS

Modular Services Company, "Profile -A new look for the patient room . . . the in-the-wall headwall," published prior to the filing date of the above application, 2002 (4 pages).

(Continued)

*Primary Examiner*—Elvin Enad
*Assistant Examiner*—Bernard Rojas
(74) *Attorney, Agent, or Firm*—Mary M. Lee

(57) ABSTRACT

A modular in-wall medical services outlet system comprising separate standardized vertical units that can be shipped separately and assembled on site to form a consolidated horizontal system. The system includes a self-aligning feature that allows the units to be leveled as a single whole and eliminates the need to level each unit separately. The alignment system may be combined with connectors which secure the units to each other. Racks of medical service outlets are included. The racks may be horizontally aligned, vertically aligned, or both. Substantially continuous trim and cover plate assemblies extend entirely across the face of the system around the outlets giving the system the appearance of an in-wall horizontal unit. The trim is attachable to the wall structure, receives the wall board, supports the service outlets, and provides horizontal equipment tracks. The frame provides the system with load bearing capacity to support equipment in the horizontal tracks.

56 Claims, 8 Drawing Sheets

U.S. PATENT DOCUMENTS

| | | | | |
|---|---|---|---|---|
| 3,410,302 | A | 11/1968 | Frick | |
| 3,455,620 | A | 7/1969 | Coburn | |
| 3,462,892 | A * | 8/1969 | Meyer | 52/28 |
| 3,491,486 | A | 1/1970 | Caruth | |
| 3,567,842 | A | 3/1971 | Meyer | |
| 3,622,684 | A | 11/1971 | Press | |
| 3,660,591 | A | 5/1972 | Schultz et al. | |
| 3,692,920 | A | 9/1972 | Santerelli | |
| 3,699,235 | A | 10/1972 | Wasson et al. | |
| 3,727,753 | A | 4/1973 | Starr et al. | |
| 3,762,398 | A | 10/1973 | Schefke et al. | |
| 3,769,502 | A | 10/1973 | Schultz et al. | |
| 3,774,522 | A | 11/1973 | Marsh | |
| 3,836,937 | A | 9/1974 | Donato | |
| 3,888,013 | A | 6/1975 | Benoit | |
| 3,921,345 | A | 11/1975 | Damico | |
| 3,931,452 | A | 1/1976 | Nilsson | |
| 4,015,397 | A | 4/1977 | Flachbarth et al. | |
| 4,017,137 | A | 4/1977 | Parks | |
| D244,465 | S | 5/1977 | Stoneman | |
| 4,104,710 | A * | 8/1978 | Damico et al. | 362/130 |
| 4,135,775 | A | 1/1979 | Driscoll | |
| 4,277,123 | A | 7/1981 | Haworth | |
| D261,804 | S | 11/1981 | Foster et al. | |
| 4,338,485 | A | 7/1982 | Fullenkamp et al. | |
| 4,354,330 | A | 10/1982 | Schwartz | |
| 4,387,949 | A | 6/1983 | Haitmanek | |
| 4,475,322 | A | 10/1984 | Russo et al. | |
| 4,559,410 | A | 12/1985 | Hostetter | |
| 4,569,163 | A | 2/1986 | Long | |
| 4,621,938 | A | 11/1986 | Weilow | |
| 4,627,684 | A | 12/1986 | D'Amato | |
| 4,642,418 | A | 2/1987 | Menchetti | |
| 4,646,211 | A | 2/1987 | Gallant et al. | |
| 4,667,579 | A | 5/1987 | Daw | |
| 4,753,055 | A | 6/1988 | Durham et al. | |
| 4,905,433 | A | 3/1990 | Miller | |
| 5,044,135 | A | 9/1991 | Kroon et al. | |
| 5,107,636 | A | 4/1992 | Schindele et al. | |
| 5,122,069 | A * | 6/1992 | Brownlie et al. | 439/131 |
| 5,186,337 | A | 2/1993 | Foster et al. | |
| 5,195,288 | A | 3/1993 | Penczak | |
| 5,247,962 | A | 9/1993 | Walker | |
| 5,284,255 | A | 2/1994 | Foster et al. | |
| 5,299,338 | A | 4/1994 | Foster | |
| 5,359,820 | A | 11/1994 | McKay | |
| D361,139 | S | 8/1995 | Nomura | |
| 5,448,859 | A | 9/1995 | Walker et al. | |
| 5,618,090 | A | 4/1997 | Montague et al. | |
| 5,644,876 | A | 7/1997 | Walker | |
| 5,653,064 | A | 8/1997 | Kappers et al. | |
| 5,673,632 | A | 10/1997 | Sykes | |
| D390,967 | S | 2/1998 | Beuster et al. | |
| D390,968 | S | 2/1998 | Kummerfeld | |
| D394,508 | S | 5/1998 | Nuzzio | |
| D404,151 | S | 1/1999 | Reichel | |
| 5,878,536 | A | 3/1999 | Demmitt et al. | |
| D411,734 | S | 6/1999 | Hsiang | |
| 5,953,871 | A | 9/1999 | MacConnell et al. | |
| 5,966,760 | A | 10/1999 | Gallant et al. | |
| D418,603 | S | 1/2000 | Gallant | |
| 6,101,731 | A | 8/2000 | Mesa | |
| 6,145,253 | A | 11/2000 | Gallant et al. | |
| 6,220,880 | B1 * | 4/2001 | Lee et al. | 439/214 |
| D443,365 | S | 6/2001 | Walker | |
| 6,256,935 | B1 | 7/2001 | Walker | |
| 6,269,594 | B1 | 8/2001 | Walker | |
| D452,573 | S | 12/2001 | Walker | |
| 6,405,491 | B1 | 6/2002 | Gallant | |
| 6,430,882 | B1 | 8/2002 | Feldpausch et al. | |
| D472,325 | S | 3/2003 | Walker | |
| 6,637,049 | B2 | 10/2003 | Gallant | |
| 6,668,493 | B1 | 12/2003 | Walker | |
| 2002/0104271 | A1 | 8/2002 | Gallant | |
| 2002/0174483 | A1 | 11/2002 | Gallant | |
| 2003/0177713 | A1 | 9/2003 | Walker et al. | |

FOREIGN PATENT DOCUMENTS

| | | |
|---|---|---|
| CA | 2228531 | 8/1999 |
| CA | 2446209 | 12/2002 |
| CA | 2447656 | 12/2002 |
| CA | 2392270 A1 | 9/2003 |
| DE | 3918379 A1 | 12/1990 |

OTHER PUBLICATIONS

Ohmeda Medical Engineering (The BOC Group, Inc.), "Ohmeda Medical Modular Headwalls. The First Choice for Patient Care and Staff Productivity." (brochure—8 pages) published United States 1985.

Photograph of Hill-Rom Co. (Hillenbrand Industries) wall unit in Noth Mississippi Women's Hospital, Tupelo, Mississippi, prior to Mar. 4, 1988 (1 page).

Photograph of Hill-Rom Co. (Hillenbrande Industries) wall unit in All Saints Cityview Hosptial, Fort Worth, TX, prior to Mar. 4, 1988(1 page).

Hill-Rom (Hillenbrand Undustries), "The First Impression Series" (brochure 12 pages) published United States 1988.

Vista Lighting, a division of JJI Lighting Group, Inc., excerpt from Vistacon brochure. Published United States prior to Mar. 19, 2002 (1 page).

Hill-Rom Services, Inc., excerpt (2 pages) from brochure published United States 1995.

Photograph of Modular Services Company wall unit, pre-installation, on sale in the United States prior to Mar. 19, 2002 (1 page).

Photograph of Hill-Rom Co. wall unit in public use prior to Mar. 4, 1988 (1 page).

* cited by examiner

MODULAR IN-WALL MEDICAL SERVICES OUTLET SYSTEM

This application claims the benefit of the filing date of provisional application Ser. No. 60/471,224, entitled "Modular In-Wall Medical Services Outlet System," filed May 16, 2003, the contents of which are incorporated herein by reference.

FIELD OF THE INVENTION

The present invention relates to devices for providing medical gas and electrical services to hospitals and other medical care facilities.

BACKGROUND OF THE INVENTION

Construction costs for hospitals and other medical care facilities depend in part on the cost of required medical equipment as well as the efficiency of installation of such equipment during the construction phase. One major item installed in most patient care areas is a wall panel for providing medical gases, vacuum and electrical services near the bedside. Modular assemblies for such panels have simplified installation of these services. Nevertheless, there remains a need to further facilitate the production and installation of these units, without sacrificing versatility or style. Horizontally oriented systems are often the most desirable, but are less convenient to install than vertical systems. Thus, there is a need for a modular system that installs as easily as a vertical system but offers the user the advantages and appearance of a horizontal system. Still further, there is a need for in-wall systems comprising vertically or horizontally aligned racks of outlets visually and structurally connected with continuous trim members.

SUMMARY OF THE INVENTION

The present invention comprises a modular in-wall medical services outlet system for installation in the wall of a structure, wherein the wall comprises wall board defining a wall space. The system comprises a plurality of interengageable vertical units. Each unit comprises a vertical frame comprising a vertical support assembly. The frame is adapted to be installed in the wall space of the structure.

At least a first medical service outlet is supported on the frame and positioned to be accessible when the unit is installed in the wall space. A trim assembly is provided for attaching to the assembled adjacent plurality of vertical units. The trim assembly is adapted to extend substantially continuously across the plurality of vertical units. The system further comprises a cover plate assembly attachable to the assembled adjacent plurality of vertical units and adapted to extend substantially continuously across the assembled plurality of vertical units.

In another aspect, the present invention comprises a medical services outlet assembly comprising at least one medical services outlet and at least one outlet support box. The outlet support box has an open front and is adapted to contain the medical services outlet. The outlet support box is horizontally elongated and adapted to be installed in the wall space of the wall of a structure. Also included is a trim assembly sized to extend across the entire width of the outlet assembly, and a cover panel assembly sized to cover the open front of all of the at least one outlet support boxes and to engage the trim assembly.

In yet another aspect, the present invention comprises a medical care facility. The facility includes a structure formed of at least one wall, and the wall comprises wall board defining a wall space. Installed in the wall of the structure is a modular in-wall medical services outlet system as described previously.

In a further aspect, the present invention comprises a method for installing a horizontal medical services outlet system in the wall of a medical care facility. A first modular vertical medical services outlet unit is connected to a second modular vertical medical services outlet unit at the installation site in the medical care facility. Then, the interconnected modular vertical units are installed in the wall space of the wall.

Further still, the present invention is directed to a modular in-wall medical services outlet system for installation in the wall space of a structure. The system includes a vertical frame comprising a vertical support assembly adapted to be installed in the wall space of the structure. A first medical service outlet is supported on the frame and positioned to be accessible when the unit is installed in the wall space. A horizontally extending equipment track is secured to the vertical frame for supporting medical support equipment.

DETAILED DESCRIPTION OF THE PREFERRED EMBODIMENT

Figure 1:
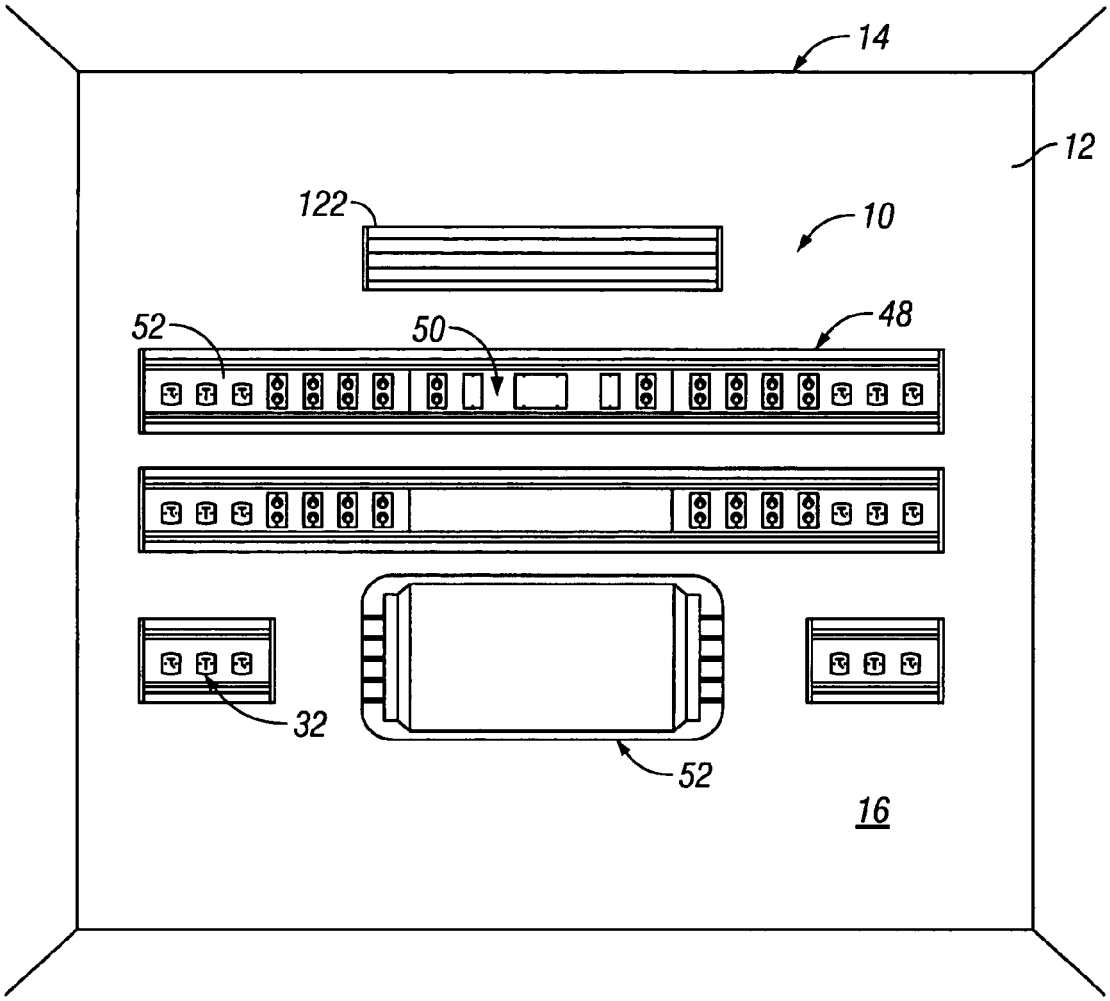
FIG. 1 is an elevational, fragmented view of a hospital room wall showing installed therein the modular medical services outlet system of the present invention.

Turning now to the drawings in general and to FIG. 1 in particular, there is shown therein a in-wall horizontally oriented medical services outlet system constructed in accordance with the present invention and designated generally by the reference numeral 10. As apparent from FIG. 1, the system 10 is designed for installation in the wall 12 of a structure 14. While a wall in a conventional hospital room is depicted, the system 10 may be installed in a variety of structures such as clinics, emergency rooms, nursing home rooms, and virtually any sort of treatment facility.

As used herein "wall" broadly denotes any one of the walls defining a room or patient care area in a hospital or other structure. The wall 12 may comprise a variety of horizontal and vertical structural members, and typically will be covered with wall board 16 that encloses and defines the inner wall space (not shown in FIG. 1).

Figure 2:
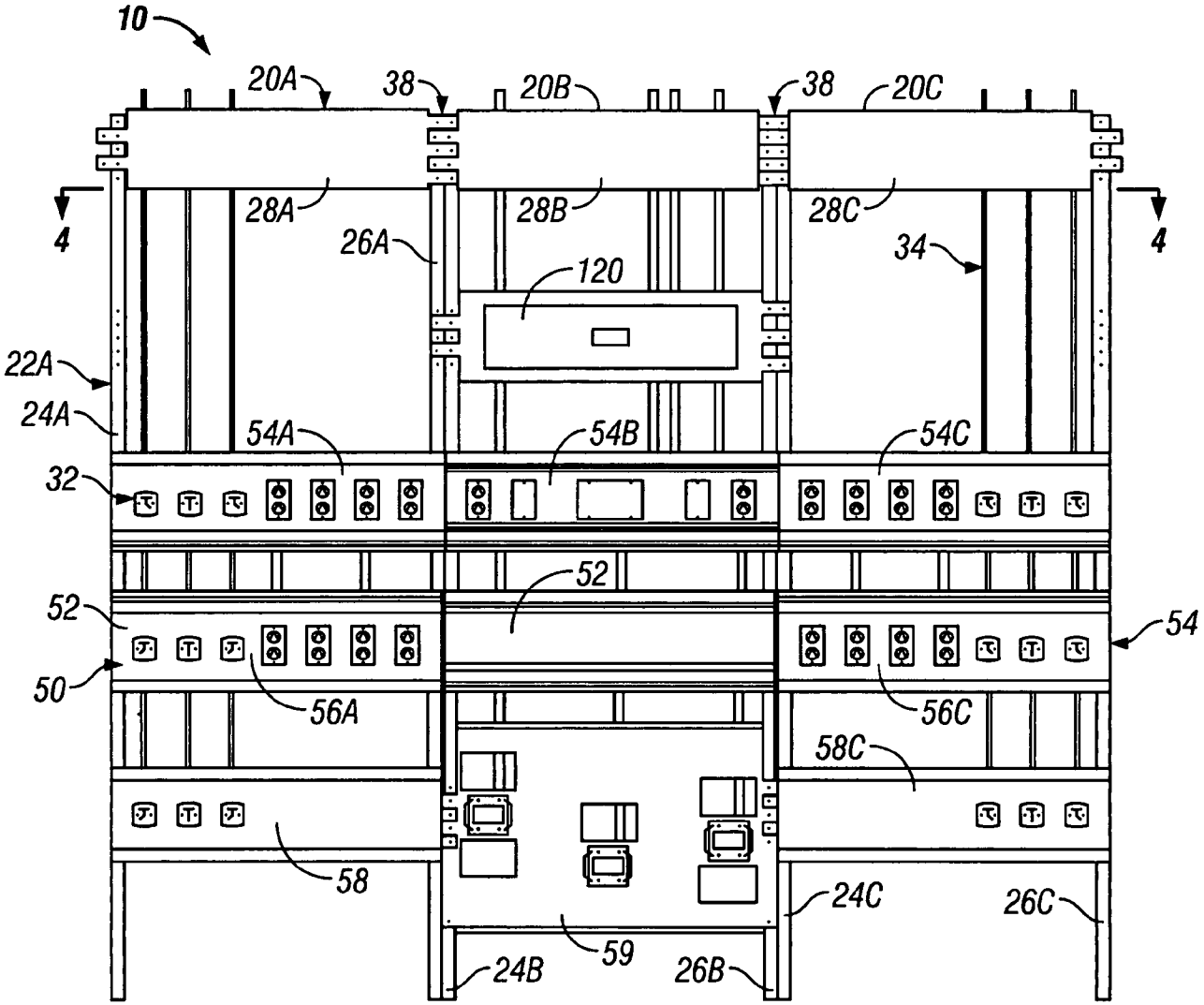
FIG. 2 is a front elevational view of the medical services outlet system immediately after assembly on site and before installation in the wall of the structure.

The system 10 presents the appearance of a horizontal headwall unit, being longer horizontally than vertically. However, as shown in FIG. 2, to which attention now also is directed, the system 10 actually is comprised of a plurality of interengageable vertical units designated generally by the reference numeral 20. More specifically, in the embodiment shown herein, the system 10 is comprises of first, second and third vertical units 20A, 20B and 20C.

As the vertical units 20A, 20B and 20C are similarly constructed, only the unit 20A will described in detail, although the corresponding components in the units 20B and 20C are identified. The vertical unit 20A comprises a vertical frame 22A providing a vertical support assembly for the components of the system 10. Although the structure of the frame may vary widely, it is conveniently formed of a pair of spaced-apart, parallel vertical C-shaped rails, such as the rails 24A and 26A, illustrated best in FIGS. 3 and 4. In the embodiment shown, the C-shaped rails are shown with the open sides facing towards each other. Of course, this arrangement may be reversed.

Figure 3:
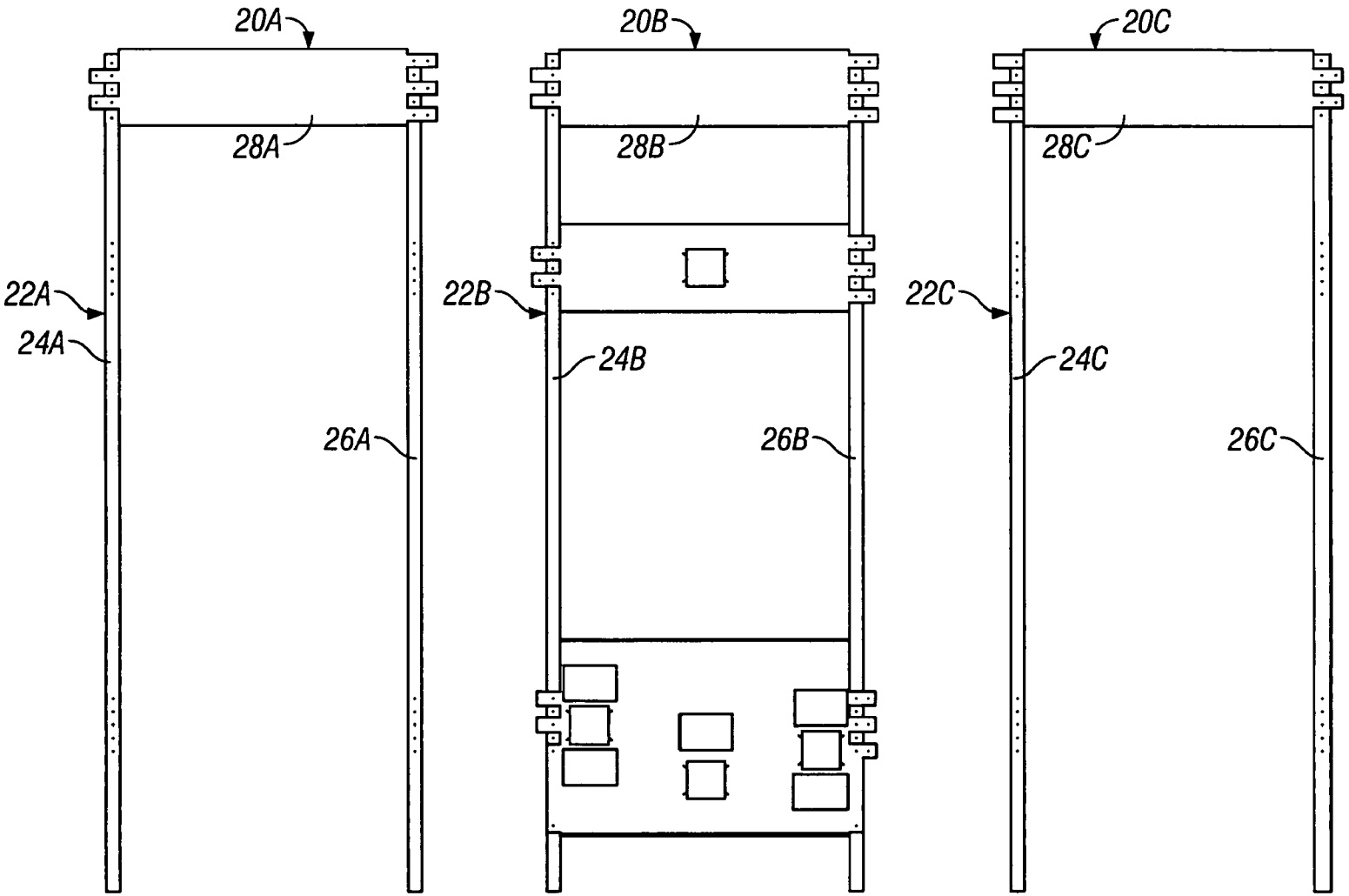
FIG. 3 is a front elevational view of the three frame assemblies forming the foundation of the medical services outlet system shown in FIG. 1.
Figure 4:
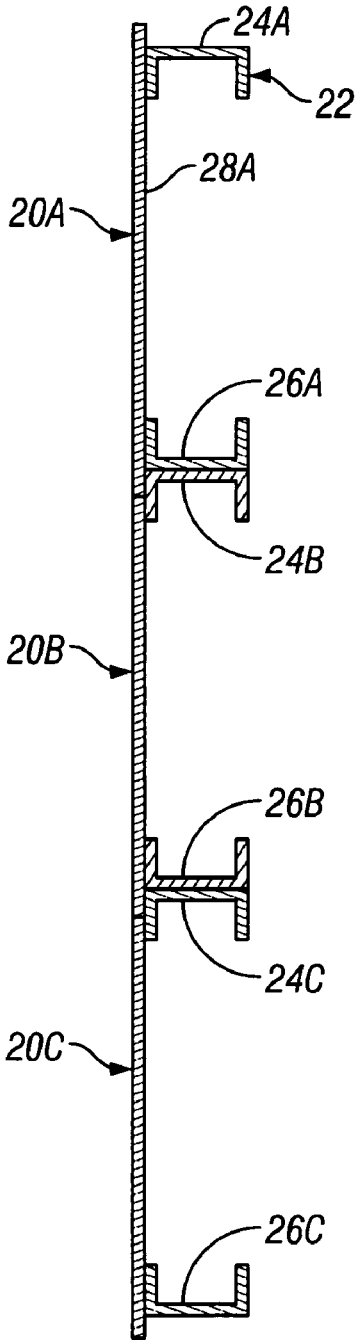
FIG. 4 is a sectional view of the frame assembly taken along line 4—4 of FIG. 2. The conduits have been omitted to simplify the illustration.

The rails 24A and 26A are attached to each other by transverse members, such as the cross plates 28A best seen in FIG. 3. The number, shape and arrangement of the cross plates 28 may vary. In the embodiment illustrated herein, each unit 20 is provided with one cross plate, as shown in FIG. 3. As will become apparent, these cross plates serve several functions in addition to stabilizing the vertical rails. The cross plates 28 may be bolted to the rails, as described hereafter (see FIG. 5) or affixed to the rails in some other suitable manner.

The frames 22A–C are adapted to be installed in the wall space 30 (see FIG. 7) of the structure 14 (FIG. 1). To that end, the depth of the frame (from front to back) may be preformed in a selected size. Alternately, the rails may be constructed to have an adjustable width.

Referring again to FIG. 1, at least a first medical service outlet is supported on the frame 22A (FIG. 2). Preferably, the system 10 includes a plurality of medical service outlets, designated in the drawings generally by the reference numeral 32. As used herein, "medical service" or "service" refers to any one of a variety of gas, electrical or communication services, including but not limited to oxygen, compressed air, vacuum (suction), electricity, telephone, computer and video cable. The outlets 32 are positioned on the frame 22A to be accessible from within the room.

In the preferred embodiment, each of the modular vertical units 20A, 20B and 20C is shipped with the necessary gas and electrical conduits installed, as will be discussed in more detail hereafter. These conduits, designated generally by the reference number 34, extend to a point at the top of the frame 22 or elsewhere, depending on where the conduits will connect to the supply source for the service. As the structure and installation of these conduits is known, they are not shown or described in detail herein.

The medical service outlets 32 may be supported on the units 20A, 20B and 20C in different ways. One preferred way is to mount the outlets in an outlet support box, or "back box," such as the back box 36 shown in FIG. 6. The back boxes 36 may be mounted in some suitable fashion to the rails 24 and 26.

Once the individual vertical units 20A, 20B and 20C are completed to the customer's specifications, they can be shipped separately and installed on the site in sections. Preferably, the units 20 are attachable to each other during installation. To that end, the system 10 may include a connecting assembly adapted to connect one unit to at least one other adjacent one of the plurality of vertical units.

Figure 5:
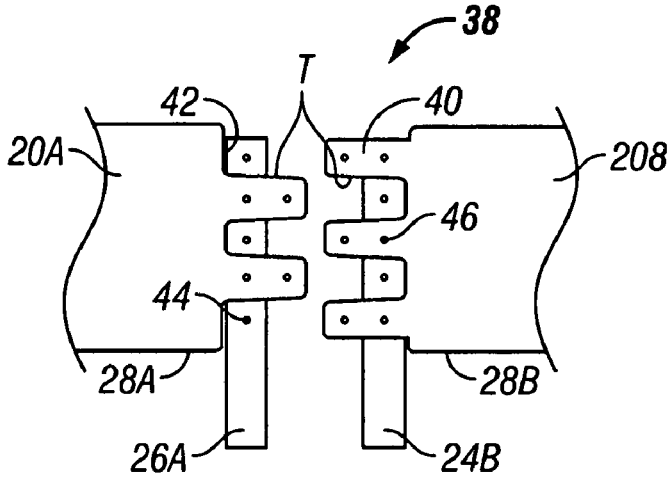
FIG. 5 is fragmented, enlarged and exploded view of adjoining portions of two adjacent vertical units illustrating the finger and notch engagement used to align and attach the units to each other.

Various types of connection devices may be used. However, a preferred connecting assembly 38 for use in the present embodiment comprises alternating notches and fingers on the ends of the cross plates 28, as shown in FIG. 5. Of course, the fingers 40 extending from unit 20A will be arranged to be received in opposing notches 42 on the adjacent unit 20B when adjacent units are abutted. Similarly, fingers 40 on the units 20B are arranged to be received in opposing notches 42 on the unit 20A. More specifically, the fingers 40 extend beyond the outer edges of the rails, while the notches 42 leave the underlying portion of the rail exposed to provide a connecting surface.

As seen in FIG. 5 and also in FIG. 2, when abutted, the fingers 40 of one unit extend into the notches 42 of the adjacent unit and overlap the exposed connecting surfaces. Fastener holes, designated collectively at 44, are provided in the ends of the fingers and in the exposed connecting portions. Once screws 46 are used to attach the fingers 40 of one unit to the rails of the adjacent unit, the units, such as the units 20A and 20B in FIG. 5, are securely connected.

Preferably, the fingers 40 and notches 42 define complementary angular shapes to resist movement therebetween. More preferably, the shape of the fingers and notches are slightly tapered, as shown at "T" in FIG. 5, as this will provide a self-guiding effect to the fingers as they slide into the notches.

Viewing the unassembled units in FIG. 3 and the assembled units in FIG. 2, it now will be appreciated that the finger/notch type arrangement serves to align the units 20 with each other accurately. In addition, because the interconnected units 20 are consolidated, there is no need to level each unit as it is installed. Rather, the system 10 can be leveled as a whole, further simplifying the installation process.

Although in the interengagement of the units and the self-aligning function conveniently are combined in the finger and notch arrangement shown in the preferred embodiment described herein, there is no need for these features to be performed by the same structure or mechanism. Rather, the two functions can be provided independently.

Returning to FIG. 1, it will be appreciated that the vertical units 20A, 20B and 20C, when installation is complete, have the appearance of a single horizontal unit. This is due in large part to the trim assembly 48, which preferably is part of the system 10. The trim assembly 48 attaches to the assembled adjacent plurality of vertical units 20 and, more preferably, the trim assembly extends substantially continuously across the several units.

As used herein, "substantially continuously" or "substantially continuous" means structurally continuous, as in one integrally formed unit, or visually continuous, as in closely abutting or overlapping structures that present the impression of being continuous or uninterrupted.

Once the wall board 16 is installed around the trim assembly 48, in the manner to be described, the resulting system 10 is trimmed out in a manner that convincingly resembles a horizontal system. Most preferably, the upper and lower trim members, respectively are integrally formed, each comprising a single extruded piece. Alternately, the trim members may be comprised of two or more pieces arranged end-to-end or overlapping in some fashion, or otherwise providing a visually continuous trim assembly when installed.

Another highly desirable component of the preferred system 10 is a cover plate assembly 50 that overlies the medical services outlets 32. Like the trim assembly 48, the cover assembly 50 is attachable to the assembled adjacent plurality of vertical units 20 and extends substantially continuously across the front of the units. A single cover plate may be utilized. However, in most cases, it will be more convenient to provide the system 10 with a cover plate for each back box or chassis. When these plates are attached end-to-end on the aligned, adjacent unit, the overall appearance is that of a single, uninterrupted cover, again contributing to the horizontal effect, as illustrated in FIG. 1.

Thus, in the preferred embodiment, the cover plate assembly 50 and the trim assembly 48 cooperate to provide a finished and attractive appearance to the installed system. The cover plates 52 are adapted to provide an interface between the interior and exterior of the vertical units 20 surrounding the medical service outlets 32, and the trim assembly 48 is adapted to frame the cover plates, one of which is designated at 52, and provide an engagement between the edge of the cover plates and the surrounding wall board 16.

Now it will be appreciated that the vertical units 20A, 20B and 20C may be provided with a wide variety of arrangements of medical service outlets 32. More specifically, each unit 20 may be provided with a varying assortment of outlet "racks," designated generally by the reference numeral 54 and seen best in FIG. 2. As used herein, a "rack" means a horizontally arranged set of outlets, usually supported in a single back box or chassis.

In the embodiment shown herein, the unit 20A is provided with two vertically aligned racks 54A and 56A of outlets 32 on the upper portion of the unit, with one small, lower rack 58A of outlets. Wall board 16 (FIG. 1) is installed above and below the racks separating the lower racks visually.

With continuing reference to FIGS. 1 and 2, the adjacent unit 20B has only one rack 54B of outlets 32 with a "blank" cover plate 52 beneath it instead of a second rack. Instead of a rack of outlets on the lower portion, the unit 20B is equipped for installation of a bed docker 59, which may or may not include service outlets. The unit 20C is formed similarly to unit 20A. When assembled, the trim assemblies 48 and the cover plate assemblies 50 visually connect the upper racks of all three units 20. The second racks of outlets 54A and 54C are horizontally aligned with a blank cover plate 52 therebetween.

Now it will be appreciated that the system 10 of this invention contemplates an assembly with a row of two or more horizontally aligned racks as well as two horizontally aligned racks with a blank section therebetween. Moreover, the present invention contemplates a set of two or more vertically aligned racks of outlets 32, including two vertically spaced racks with a blank section in between. It will also be understood that the blank section may be covered with a cover plate, such as the cover plate 52 between the racks 56A and 56C matching the cover plate surrounding the outlets, or with a cover made simply of wall board 16, as shown between the rack 54A and 56A, depending on the desires of the customer. In all these arrangements, though, the use of a substantially continuous trim assembly 48 that receives the surrounding wall board 16 creates a visually cohesive system 10 that is simple to install and aesthetically pleasing.

Figure 6:
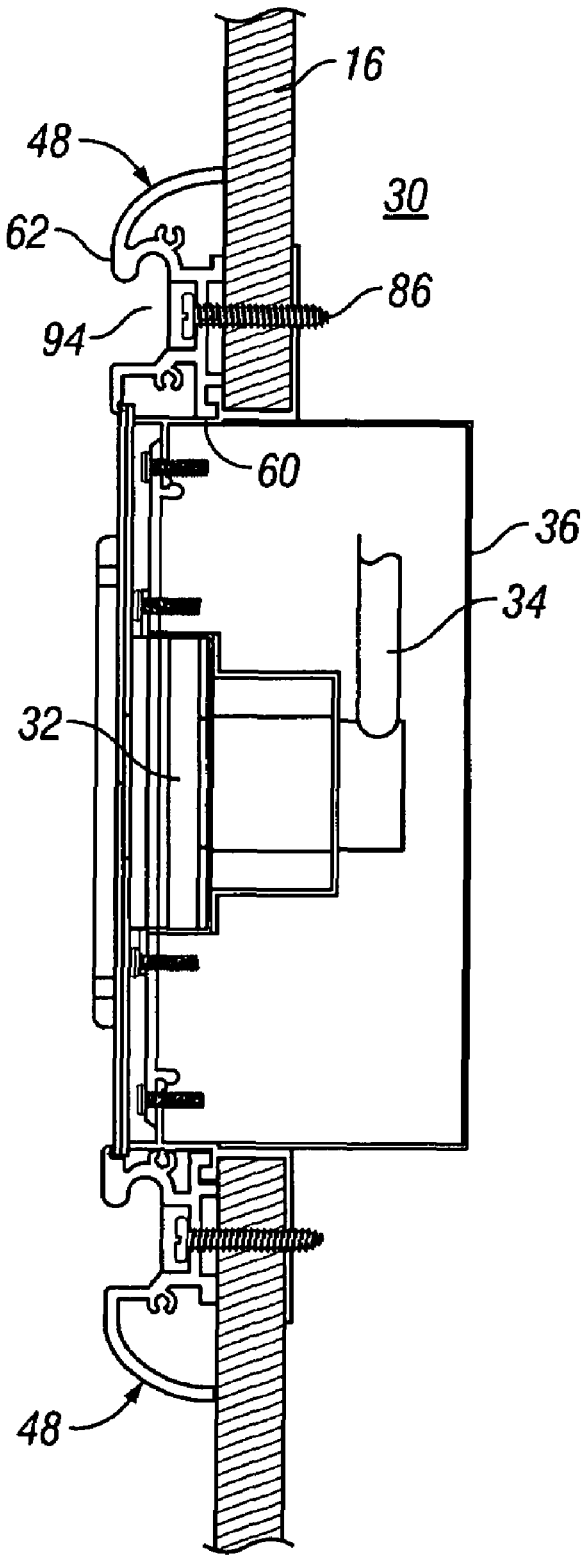
FIG. 6 is vertical sectional, fragmented view taken through a portion of one of the vertical units showing the trim assembly supporting a rack of service outlets.
Figure 7:
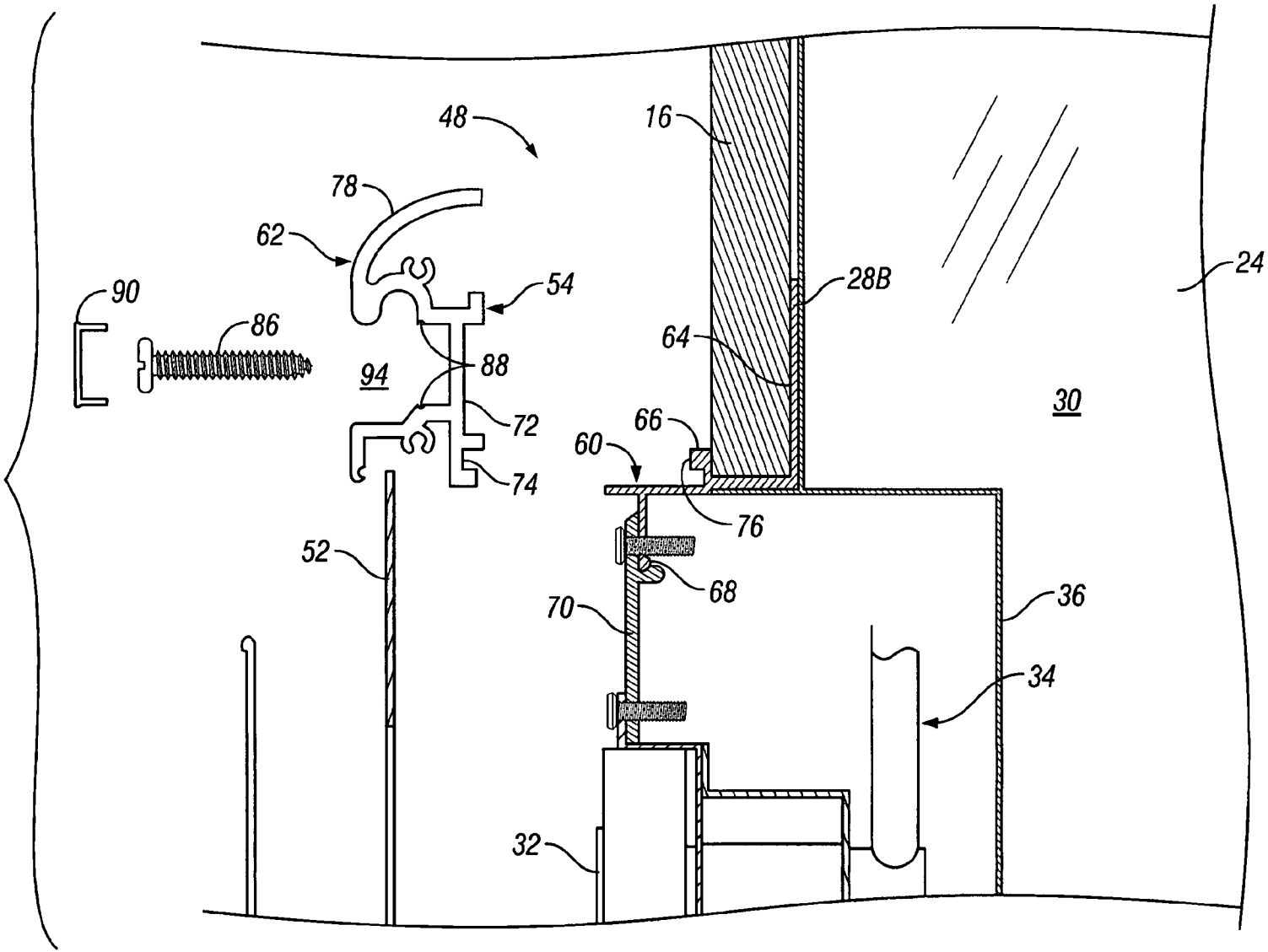
FIG. 7 is an enlarged, fragmented and exploded view of a portion of the unit shown in FIG. 6.
Figure 8:
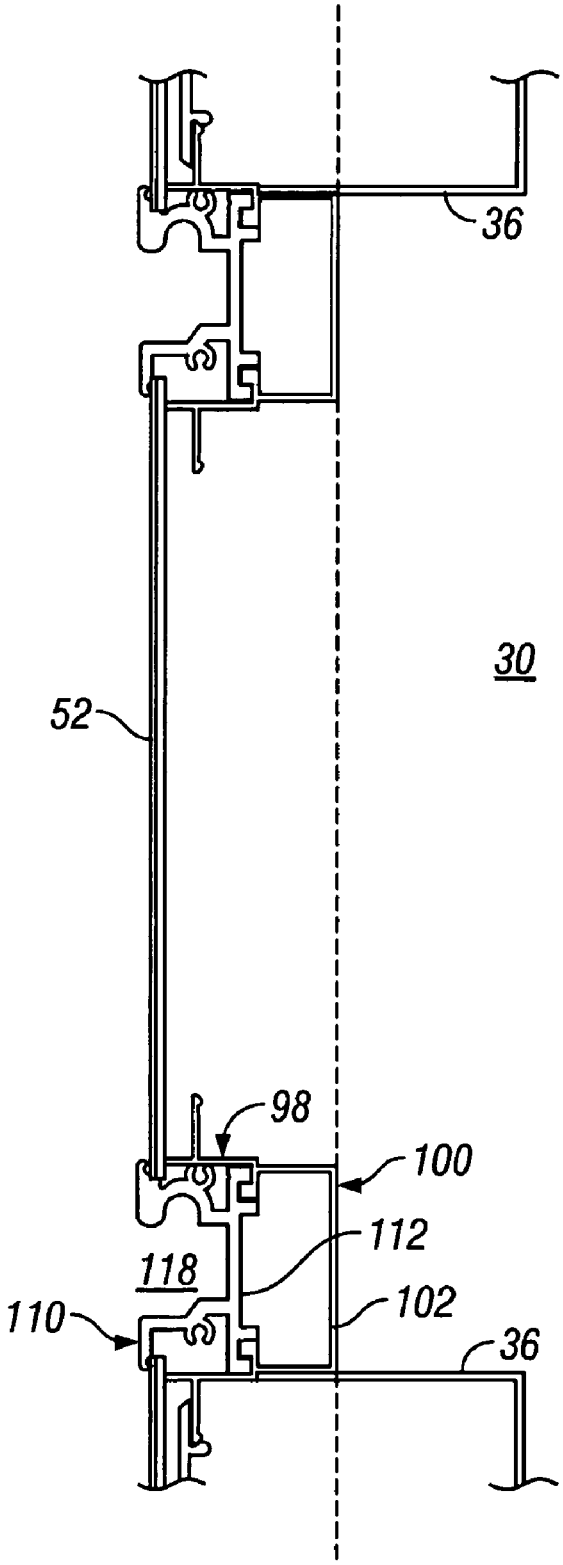
FIG. 8 is a vertical sectional, fragmented view taken through a lower portion of the vertical unit shown in FIG. 2 illustrating the horizontal trim assemblies supporting a blank center panel section between vertically aligned upper and lower racks of outlets.
Figure 9:
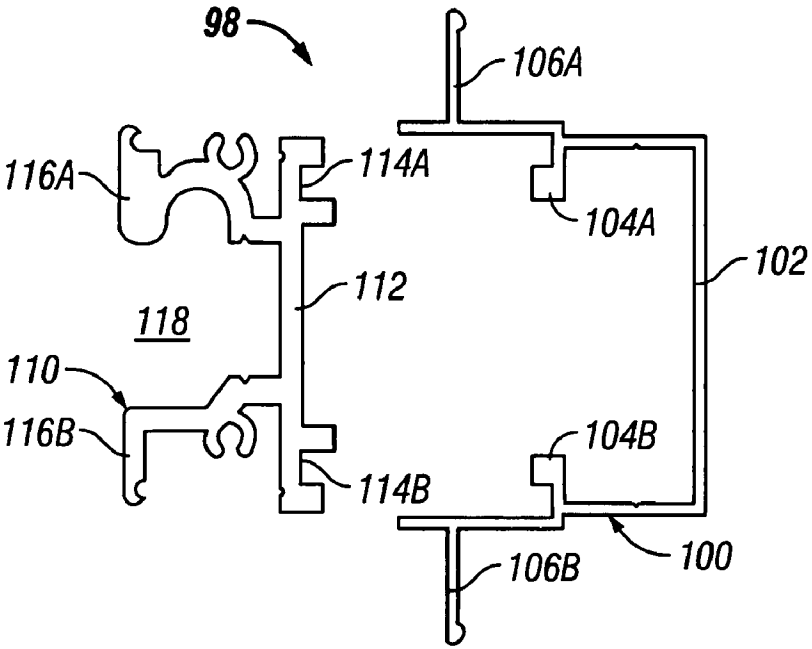
FIG. 9 is an enlargement of the interior and exterior trim assembly shown in FIG. 8.

With reference now to FIGS. 6–9, the preferred trim assembly 48 will be described in more detail. The profile of the trim assembly 48 will vary depending on whether the trim extends between wall board 16 and fascia, as shown in FIGS. 6 and 7, or between fascia and fascia, as shown in FIGS. 8 and 9.

FIG. 6 illustrates the upper and lower trim assemblies for above and below a single rack of outlets, where wall board 16 will be installed immediately above and below the rack, such as the rack 54A in unit 20A (FIG. 2). The upper and lower trim pieces generally are formed so that the profile of the lower trim mirrors that of the upper trim, except that the equipment track, discussed hereafter, is upright in both.

The preferred trim assembly 48 comprises an internal trim member 60 and an external trim member 62. As best seen in FIG. 7, the internal trim member 60 preferably comprises three functional components. A first component comprises a support flange 64 that provides a surface for connecting the internal trim member 60 to the rails 24 and 26. Because the trim allows the rack of outlets 32 to be attached to the frame 22, the wall surface in which the system is mounted is provided with increased rigidity.

A second component comprises a wall board flange 66 adapted to receive or contain wall board 16. A third component comprises a device mounting flange 68 adapted to support medical service outlets 32. More specifically, the device mounting flange 68 is adapted to support an outlet mounting plate 70 on which the outlets 32 are attached. The internal trim member 60 in most instances will be fixed to the top edge of the back box 36 that is supported on the rails 24 and 26.

The preferred external trim member 62 has a rear profile that includes a spine 72 and a recess 74 shaped to engage a lip 76 on the wall board flange 66 of the internal trim member 60. The external trim member 62 preferably also has a wall board edge portion 78 attractively contoured and sized to reach back toward the surface of the underlying wall board 16.

The external trim member 62 is applied over the internal trim member 60 after the wall board 16 is installed. Then a screw 86 is inserted through the trim members 60 and 62 and the wall board 16, aligning and stabilizing all the elements. This facilitates distribution of accessory loads (medical support equipment) in the trim member 62 directly to the rails 24 and 26. The external trim member 62 may be provided with opposing grooves 88 to receive the edges of a trim strip 90 used to cover the screw heads.

As best seen in FIG. 6, when assembled, the external trim member 62 defines a horizontally extending equipment track 94. The equipment track 94 is adapted to receive and support the adaptors on a wide variety of medical support equipment for ready availability at the bedside. Moreover, because the trim assembly 48 runs continuously the length of the installed headwall system 10, equipment supported in the track can be moved from one side of the bed to the other by simply sliding the equipment along the length of the track.

Now it will be understood that the trim assembly 48 with its horizontal equipment tracks easily could be extended a distance beyond the underlying frame 22. This would provide equipment support capacity across the wall 12 by securing the trim to the underlying wall studs.

Turning now to FIGS. 8 and 9, there is illustrated a slightly different trim assembly 98 for use where the trim interfaces between the cover plate 52 (FIGS. 6 & 7) surrounding the outlets 32 and a blank cover plate 52. The screws connecting the trim to the wall and the conduits have been omitted to simplify the illustration.

The internal trim member 100 comprises a support surface 102 shaped to abut the rails 24 and 26 (FIG. 2). Extending forwardly from the top and bottom edges of the support surface 102 are trim flanges 104A and 104B adapted to receive a portion of the external trim member described hereafter. Extending upwardly and downwardly from the internal trim member 100 are device mounting flanges 106A and 106B. While both may not be used, the inclusion of both allows the internal trim member 100 to be used above or below an outlet rack, as illustrated in FIG. 8.

The trim assembly 98 further preferably comprises an external trim member 110. The external trim member 110 comprises a spine 112. Above and below the spine 112, the external trim member 110 is provided with trim engaging recesses 114A and 114B adapted to receive the trim flanges 104A and 104B of the internal trim member 100. Extending forwardly from the trim engaging recesses 114A and 114B, are cover flanges 116A and 116B extending upwardly and downwardly, respectively. The cover flanges 116A and 116B are adapted to receive the edges of cover plates 52 in the manner described above. The external trim member 110 also may be provided with a horizontally extending equipment track 118. A trim strip similar to the trim strip 90 may be included but is not shown here.

Returning to FIG. 2, the system 10 preferably has one or more junction boxes 120 for the electrical conduits 34 in the units 20A, 20B and 20C. For example, a junction box 120 can be conveniently concealed behind an over bed light 122 (FIG. 1). This makes the system less costly to install and easily accessible for maintenance and repair from inside the room.

FIG. 2 shows three pre-wired, pre-piped vertical units 20A–C after assembly and immediately before installation in the wall. Now it will be appreciated that each of these units is fully assembled at the factory or manufacturing plant for separate shipment. That is, in the shipment-ready unit, the outlets 32 are mounted in the back boxes 36 (FIGS. 6 and 8) and the conduits 34 for electrical wires and gas lines attached. Each unit can be shipped with other units selected according to the customer's specifications. A packet containing appropriate cover plates, connectors and trim assemblies are included with the units when shipped.

Having described the modular vertical units and their various components, the method of the present invention will be explained. First, the configuration of the particular system is designed. Next, an order is placed for the required units, which are then assembled and shipped to the installation site.

Preferably, the vertical units used in the method of this invention will be the units described previously, though this is not essential. In most instances, the vertical units 20 will be shipped with the service outlets and internal trim members of the trim assemblies installed on the units, while the external trim members, cover plates, trim strips and assorted connectors are included but packaged separately.

Once all the necessary components have been received at the installation site, the vertical units are unpacked and connected to each other, preferably by the self-aligning, interengaging fingers and notches, described previously. Next, the interconnected vertical units are placed into the wall space and leveled as a single whole. Once properly leveled, the frames of the vertical units are secured to adjacent vertical wall studs.

The finishing steps will be described with reference to FIGS. 6–9. After the interconnected vertical units 20A–C have been secured in the wall 12, the wall board 16 is installed around the internal trim members 60 of the trim assembly 48. The external trim members 62 of the trim assembly then can be affixed to the internal members 60 and the screws 86 inserted through the spine 72 of the external member 62, the wall board 16, the support flange 64 behind the wall board 16, and finally into the supporting rails 24 and 26 (or, between the rails, into the cross plates). The cover plates 52 and screws 86 are attached as previously described. Next, the trim strips 90 are snapped into place over the screws 86, and the vertical trim strips (seen only in FIG. 1) are attached to the edges of the racks to complete the installation.

Figure 10:
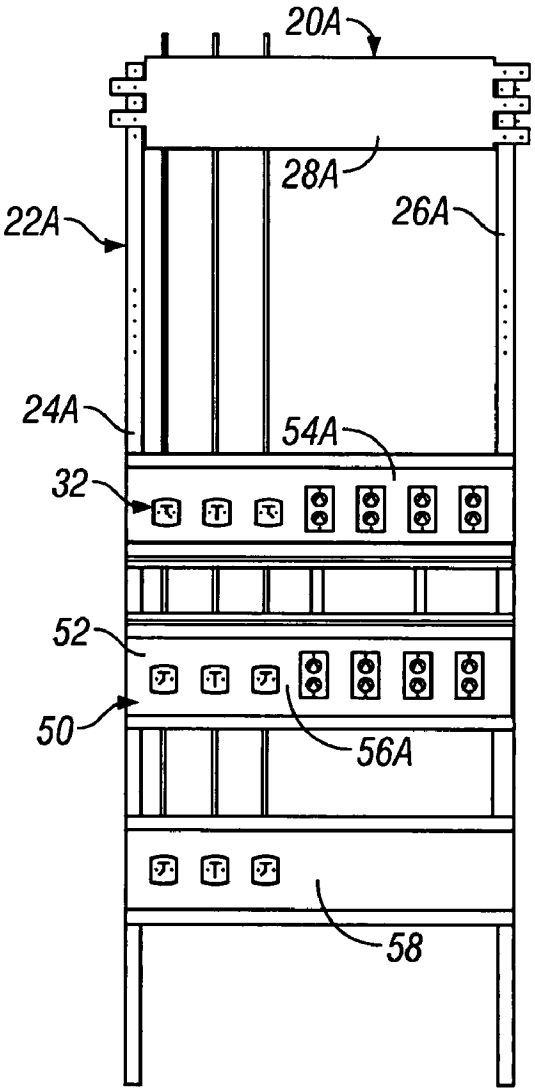
FIG. 10 is an elevational view of an exemplary modular vertical unit with the medical services outlets and related conduits installed and ready for shipment.

As will now be apparent, any of the units 20A–C shown assembled in FIG. 2, could be manufactured, shipped and installed as a single unit system. By way of example, an enlarged view of the unit 20A is shown in FIG. 10. This unit, even standing alone as an in-wall outlet system, provides substantial load capacity because of the preattached vertical support frame and, thus, can support one or more horizontal equipment tracks. In addition, the equipment load capacity can be tested in the factory prior to shipment, eliminating the need for the contractor to perform this time-consuming task at the time of installation.

The system of the present invention may be augmented with various additional features, some of which are described in co-pending application Ser. No. 10/100,768, filed Mar. 19, 2002, entitled "Modular In-Wall Medical Services Unit," the contents of which are incorporated herein by reference. It will also be apparent that the system of this invention contemplates a dual-sided system, as is disclosed in the cited application.

Now it will be appreciated that the horizontal medical services system of the present invention provides several advantages at both the manufacturing level as well as at the point of installation. The individual vertical frames can be standardized and prefabricated. The main structural components, such as the frames shown in FIG. 3, can be manufactured and kept in inventory. Upon receipt of an order describing a specific system, the units can be assembled quickly and adjusted as necessary. Each unit of the selected group of vertical units is shipped individually, avoiding the difficulties associated with shipment of a true horizontal system of the same size. The units are positioned, aligned and connected on site, with a minimum of effort aided by the self-aligning and self leveling features of the cross plates and interengageable fingers and notches.

Changes can be made in the combination and arrangement of the various parts and steps described herein without departing from the spirit and scope of the invention.

What is claimed is:

1. A modular in-wall medical services outlet system for installation in the wall of a structure, the wall comprising wall board defining a wall space, the system comprising:

a plurality of separable and interengageable vertical units, wherein each unit comprises a vertical frame comprising a vertical support assembly, the frame adapted to be installed in the wall space of the structure; and at least a first medical service outlet supported on at least one of the vertical units and positioned to be accessible when the unit is installed in the wall space;

a cover plate assembly attachable to the plurality of vertical units when the plurality of vertical units are interengaged, wherein the cover plate assembly overlies the first medical service outlet and is adapted to extend substantially continuously across the assembled plurality of vertical units; and a trim assembly attachable to the plurality of vertical units when the plurality of vertical units are interengaged, wherein the trim assembly is adapted to at least partially frame the cover plate assembly and to extend substantially continuously across the plurality of interengaged vertical units.

2. The medical services system of claim 1 wherein the vertical support assembly comprises a pair of parallel spaced-apart vertical rails.

3. The medical services system of claim 1 wherein the at least one medical services outlet comprises a plurality of service outlets.

4. The medical services system of claim 3 further comprising a service conduit adapted to service at least one of the plurality of medical service outlets.

5. The medical services system of claim 3 wherein each of the plurality of vertical units comprises a pair of vertically aligned horizontal racks of service outlets.

6. The medical services system of claim 5 wherein each of the plurality of vertical units comprises a blank panel extending between and adjacent to the pair of vertically aligned horizontal racks of service outlets.

7. The medical services system of claim 3 wherein each of the plurality of vertical units comprises a horizontal rack of service outlets, and wherein the horizontal racks are horizontally aligned.

8. The medical services system of claim 7 wherein the system further comprises three vertical units including first, second and third vertical units, wherein the first and third vertical units have horizontally aligned horizontally racks of service outlets, wherein the second vertical unit is positioned between and adjacent to the first and third units, and wherein the second unit comprises a horizontal blank panel sized similarly to and horizontally aligned with the horizontal racks of service outlets on the adjacent first and third units.

9. The medical services system of claim 1 further comprising an alignment assembly adapted to align one of the plurality of vertical units to at least one other adjacent one of the plurality of vertical units.

10. The medical services system of claim 9 wherein the alignment assembly of each of the vertical units comprises at least one set of interengageable fingers and notches.

11. The medical services system of claim 10 wherein the at least one set of interengageable fingers and notches comprises a plurality of such sets.

12. The medical services system of claim 10 wherein the at least one set of interengageable fingers and notches are provided with complementary tapered edges whereby the fingers are self-guiding as they slide into the notches.

13. The medical services system of claim 11 wherein the at least one set of fingers and notches define complementary angular shapes.

14. The medical services system of claim 1 wherein the trim assembly comprises an internal structural trim member.

15. The medical services system of claim 14 wherein the internal trim member comprises:

a support flange adapted to be attached to the vertical frame;

a wall board flange adapted to receive the wall board; and a device mounting flange adapted to support medical service outlets.

16. The medical services system of claim 15 wherein the internal trim member is integrally formed.

17. The medical services system of claim 1 wherein the trim assembly comprises an external trim member.

18. The medical services system of claim 17 wherein the external trim member is adapted to engage the internal trim member.

19. The medical services system of claim 17 wherein the external trim member comprises a horizontally extending equipment track.

20. The medical services system of claim 1 wherein the vertical unit comprises an outlet support box supported on the frame and adapted to contain the medical services outlet.

21. The medical services system of claim 1 wherein the cover plate assembly comprises a plurality of cover plates.

22. The medical services system of claim 1 wherein the cover plate assembly comprises at least one cover plate, and wherein the at least one cover plate is adapted to provide an interface between the interior and exterior of the vertical units surrounding the medical service outlets.

23. The medical services system of claim 22 wherein the trim assembly is adapted to frame the cover plate assembly and provide an engagement between the edge of the cover plates and the surrounding wall board.

24. The medical services system of claim 1 wherein the trim assembly is adapted to frame the cover plate assembly and provide an engagement between the cover plate assembly and the surrounding wall board.

25. The medical services system of claim 1 further comprising:

a service conduit adapted to service the at least one medical service outlet; and a junction box supported on the frame below the ceiling and above the at least one medical service outlet.

26. The medical services system of claim 25 further comprising an overbed light and wherein the junction box is supported in the frame behind the overbed light.

27. The medical services system of claim 1 comprising at least one alignment assembly adapted simultaneously to align and connect one of the plurality of vertical units to at least one other adjacent one of the plurality of vertical units.

28. The medical services system of claim 27 wherein the at least one alignment assembly comprises a plurality of alignment assemblies.

29. A medical care facility comprising:

a structure formed of at least one wall, wherein the wall comprises wall board defining a wall space;

a modular in-wall medical services outlet system installed in the wall of the structure, the system comprising:

a plurality of separable and interengageable vertical units, wherein each unit comprises a vertical frame comprising a vertical support assembly, the frame adapted to be installed in the wall space of the structure; and at least a first medical service outlet supported on at least one of the vertical units and positioned to be accessible when the unit is installed in the wall space;

a cover plate assembly attachable to the plurality of vertical units when the plurality of vertical units are interengaged, wherein the cover plate assembly overlies the first medical service outlet and is adapted to extend substantially continuously across the assembled plurality of vertical units; and a trim assembly attachable to the plurality of vertical units when the plurality of vertical units are interengaged, wherein the trim assembly is adapted to at least partially frame the cover plate assembly and to extend substantially continuously across the plurality of interengaged vertical units.

30. The medical care facility of claim 29 wherein the vertical support assembly comprises a pair of parallel spaced-apart vertical rails.

31. The medical care facility of claim 29 wherein the at least one medical services outlet comprises a plurality of service outlets.

32. The medical care facility of claim 31 further comprising a service conduit adapted to service at least one of the plurality of medical service outlets.

33. The medical care facility of claim 31 wherein each of the plurality of vertical units comprises a pair of vertically aligned horizontal racks of service outlets.

34. The medical care facility of claim 33 wherein each of the plurality of vertical units comprises a blank panel extending between and adjacent to the pair of vertically aligned horizontal racks of service outlets.

35. The medical care facility of claim 31 wherein each of the plurality of vertical units comprises a horizontal rack of service outlets, and wherein the horizontal racks are horizontally aligned.

36. The medical care facility of claim 35 wherein the system further comprises three vertical units including first, second and third vertical units, wherein the first and third vertical units have horizontally aligned horizontally racks of service outlets, wherein the second vertical unit is positioned between and adjacent to the first and third units, and wherein the second unit comprises a horizontal blank panel sized similarly to and horizontally aligned with the horizontal racks of service outlets on the adjacent first and third units.

37. The medical care facility of claim 29 further comprising an alignment assembly adapted to connect the one of the at least one vertical unit to at least one other adjacent one of the plurality of vertical units.

38. The medical care facility of claim 37 wherein the alignment assembly comprises at least one set of interengageable fingers and notches.

39. The medical care facility of claim 38 wherein the at least one set of interengageable fingers and notches comprises a plurality of such sets.

40. The medical services system of claim 38 wherein the at least one set of interengageable fingers and notches are provided with complementary tapered edges whereby the fingers are self-guiding as they slide into the notches.

41. The medical care facility of claim 40 wherein the fingers and notches define complementary angular shapes.

42. The medical care facility of claim 29 wherein the trim assembly comprises an internal structural trim member.

43. The medical care facility of claim 42 wherein the internal trim member comprises:

a support flange adapted to be attached to the vertical frame;

a wall board flange adapted to receive the wall board; and a device mounting flange adapted to support medical service outlets.

44. The medical care facility of claim 38 wherein the internal trim member is integrally formed.

45. The medical care facility of claim 29 wherein the trim assembly comprises an external trim member.

46. The medical care facility of claim 45 wherein the external trim member is adapted to engage the internal trim member.

47. The medical care facility of claim 45 wherein the external trim member comprises a horizontally extending equipment track.

48. The medical care facility of claim 29 wherein the vertical unit comprises an outlet support box supported on the frame and adapted to contain the medical services outlet.

49. The medical care facility of claim 29 wherein the cover plate assembly comprises a plurality of cover plates.

50. The medical care facility of claim 29 wherein the cover plate assembly comprises at least one cover plate, and wherein the at least one cover plate is adapted to provide an interface between the interior and exterior of the vertical units surrounding the medical service outlets.

51. The medical care facility of claim 50 wherein the trim assembly is adapted to frame the cover plate assembly and provide an engagement between the edge of the cover plates and the surrounding wall board.

52. The medical care facility of claim 29 wherein the trim assembly is adapted to frame the cover plate assembly and provide an engagement between the cover plate assembly and the surrounding wall board.

53. The medical care facility of claim 29 wherein the medical services outlet system further comprises:

a service conduit adapted to service the at least one medical service outlet; and a junction box supported on the frame below the ceiling and above the at least one medical service outlet.

54. The medical care facility of claim 53 wherein the medical services outlet system further comprises an overbed light and wherein the junction box is supported in the frame behind the overbed light.

55. The medical care facility of claim 29 wherein the medical services outlet system further comprises at least one alignment assembly adapted simultaneously to align and connect one of the plurality of vertical units to at least one other adjacent one of the plurality of vertical units.

56. The medical care facility of claim 55 wherein the at least one alignment assembly comprises a plurality of alignment assemblies.

* * * * *